US008379875B2

(12) United States Patent
Hämäläinen

(10) Patent No.: US 8,379,875 B2
(45) Date of Patent: Feb. 19, 2013

(54) METHOD FOR EFFICIENT BEAMFORMING USING A COMPLEMENTARY NOISE SEPARATION FILTER

(75) Inventor: Matti S. Hämäläinen, Lempäälä (FI)

(73) Assignee: Nokia Corporation, Espoo (FI)

( * ) Notice: Subject to any disclaimer, the term of this patent is extended or adjusted under 35 U.S.C. 154(b) by 1320 days.

(21) Appl. No.: 11/015,755

(22) Filed: Dec. 16, 2004

(65) Prior Publication Data

US 2005/0141731 A1 Jun. 30, 2005

Related U.S. Application Data

(60) Provisional application No. 60/532,360, filed on Dec. 24, 2003.

(51) Int. Cl.
*H04R 3/00* (2006.01)

(52) U.S. Cl. ..... 381/92; 381/94.1; 381/317; 367/119

(58) Field of Classification Search ..... 381/66, 381/91–93, 122, 94.1–94.3, 317; 367/119
See application file for complete search history.

(56) References Cited

U.S. PATENT DOCUMENTS

| | | | | |
|---|---|---|---|---|
| 4,741,038 A | | 4/1988 | Elko et al. | |
| 4,956,867 A | | 9/1990 | Zurek et al. | |
| 5,542,101 A | | 7/1996 | Pal | |
| 5,581,495 A | | 12/1996 | Adkins et al. | |
| 5,581,620 A | * | 12/1996 | Brandstein et al. | 381/92 |
| 5,627,799 A | * | 5/1997 | Hoshuyama | 367/121 |
| 5,687,162 A | | 11/1997 | Yoshida et al. | |
| 6,049,607 A | | 4/2000 | Marash et al. | |
| 6,269,516 B1 | | 8/2001 | Saatjian et al. | |
| 6,275,592 B1 | | 8/2001 | Vartiainen | |
| 6,449,586 B1 | * | 9/2002 | Hoshuyama | 702/190 |
| 6,449,593 B1 | * | 9/2002 | Valve | 704/233 |

(Continued)

FOREIGN PATENT DOCUMENTS

| | | |
|---|---|---|
| EP | 1 184 676 A1 | 3/2002 |
| KR | 1019990071136 | 9/1999 |

(Continued)

OTHER PUBLICATIONS

Claesson I, Nordholm S., "A Spatial Filtering Approach to Robust Adaptive Beaming,", IEEE Transactions on Antennas and Propagation, Communications, vol. 40, No. 9, Sep. 1992, pp. 1093-1096.

(Continued)

*Primary Examiner* — Disler Paul
(74) *Attorney, Agent, or Firm* — Alston & Bird LLP

(57) ABSTRACT

This invention describes a method for efficient beamforming for generalized sidelobe canceling using complementary noise separation filtering for generating a noise reference for adaptation performance of an adaptive interference canceller (AIC). The adaptive filter provides noise estimates to be subtracted from the desired signal path providing further noise reduction in the system output. More specifically, the present invention relates to a multi-microphone beamforming system similar to a generalized sidelobe canceller (GSC) structure, but the difference with the conventional GSC method is that the complementary filter used for desired signal blocking can be realized with a simple subtraction without compromising the beam steering flexibility of the polynomial beamforming filter front end using the desired target signal and the complementary background noise estimate signal, respectively, with the complexity of one complementary filter and one sum beamformer.

38 Claims, 4 Drawing Sheets

U.S. PATENT DOCUMENTS

| | | | | |
|---|---|---|---|---|
| 6,611,600 | B1 | 8/2003 | Leber et al. | |
| 6,805,769 | B2 | 10/2004 | Okuda et al. | |
| 6,831,986 | B2 | 12/2004 | Kates | |
| 6,888,949 | B1 | 5/2005 | Vanden Berghe et al. | |
| 6,937,980 | B2 * | 8/2005 | Krasny et al. | 704/231 |
| 7,092,882 | B2 * | 8/2006 | Arrowood et al. | 704/233 |
| 7,317,801 | B1 * | 1/2008 | Amir | 381/71.1 |
| 7,778,425 | B2 | 8/2010 | Kajala et al. | |
| 2001/0048740 | A1 | 12/2001 | Zhang et al. | |
| 2002/0080980 | A1 | 6/2002 | Matsuo | |
| 2002/0141601 | A1 | 10/2002 | Finn et al. | |
| 2003/0063759 | A1 | 4/2003 | Brennan et al. | |
| 2004/0013038 | A1 * | 1/2004 | Kajala et al. | 367/119 |
| 2005/0147258 | A1 | 7/2005 | Myllyla et al. | |

FOREIGN PATENT DOCUMENTS

| | | | |
|---|---|---|---|
| WO | WO 02/18969 | A1 | 3/2002 |

OTHER PUBLICATIONS

Nordebo S., Claesson I, Nordholm S. "Broadband Adaptive Beamforming: A Design Using 2-D Spatial Filters" Antennas and Propagation Society International Symposium, MI, USA 1993.

Kajala M., Hämäläinen M., MyllyläV., "A Method for Generating Noise References for Adaptive Sidelobe Cancelling", NRC Invention Report NC37098.

George-Othon Glentis, et al, Efficient Least Squares Adaptive Algorithms for FIR Transversal Filtering, IEEE Signal Processing Magazine, Jul. 1999 p. 13-41.

International Search Report and Written Opinion for Application No. PCT/IB04/04166 dated Jun. 14, 2005.

Supplemental European Search Report for Application No. EP 04 80 6365 dated Dec. 17, 2009.

Adaptive Filter Theory, 4$^{th}$ Ed., S. Haykin, Prentice Hall, Upper Saddle River, NJ, 2002, pp. 327-331.

* cited by examiner

METHOD FOR EFFICIENT BEAMFORMING USING A COMPLEMENTARY NOISE SEPARATION FILTER

PRIORITY AND CROSS-REFERENCE TO RELATED APPLICATION

This application claims priority from U.S. Provisional Patent Application Ser. No. 60/532,360 filed Dec. 24, 2003.

This application discloses subject matter which is also disclosed and which may be claimed in U.S. pat. application Ser. No. 10/746,843, filed Dec. 24, 2003, and U.S. patent application Ser. No. 10/745,945, filed Dec. 24, 2003 (now issued U.S. Pat. No. 7,778,425, issued Aug. 17, 2010). filed on even date herewith.

TECHNICAL FIELD

This invention generally relates to acoustic signal processing and more specifically to efficient beamforming for generalized sidelobe canceling using complementary noise separation filtering for generating a noise reference.

BACKGROUND ART

A beam, referred to in the present invention, is a processed output target signal of multiple receivers. A beamformer is a spatial filter that processes multiple input signals (spatial samples of a wave field) and provides a single output picking up the desired signal while filtering out the signals coming from other directions. The term adaptive beamformer refers to a well-known generalized sidelobe canceller (GSC), which is a combination of a beamformer providing the desired signal output and an adaptive interference canceller (AIC) part that produces noise estimates that are then subtracted from the desired signal output further reducing any ambient noise left there on the desired signal path. There are also other adaptive beamforming methods and their modifications but they all have the same fundamental problems. Desired signal is, e.g. a speech signal coming from the direction of the source and noise signals are all other signals present in the environment including reverberated components of the desired signal. Reverberation occurs when a signal (acoustical pressure wave or electromagnetic radiation) hits an obstacle and changes its direction possibly reflecting back to the system from another direction.

Filter and sum beamformers provide a robust beamforming technique that is very flexible and can be optimized for many array configurations. The main disadvantage of filter and sum beamformers is that the number of microphones and the size of the array set a limit to their performance. In mobile applications the size of the array is usually limited by the physical size of the product and the increase in the number of microphones introduces undesirable mechanical design complications and increases the manufacturing costs. Therefore, techniques that improve the beamformer performance through improved digital signal processing techniques can reuse the CPU capabilities of the product platform and provide a cost efficient multi-microphone front-end compared to increasing the number of microphones.

A major problem in prior-art GSC adaptive filtering is the desired signal leakage to the adaptive filters that causes desired signal deterioration in the system output. The operation of the adaptive filter influenced dramatically by the characteristics of the background noise estimate. When the desired signal is "leaking" to the background noise estimate, the adaptive filter will try to remove those signal components from the (desired) output. This is a typical problem in nearly all prior-art adaptive beamforming filter systems.

Also, when the target is moving, the beam direction must be changed accordingly requiring calculation of a new blocking matrix or using pre-steering as described by Claesson and Nordholm, "A Spatial Filtering Approach to Robust Adaptive Beaming", IEEE Trans. on Antennas and Propagation, Vol. 40, No. 9, Sep. 1992. In prior-art systems steering is typically not considered and the beamformer is assumed to point in only one known fixed look (target) direction. Products that utilize multimicrophone beamforming do not follow the target signal either.

In conventional GSCs, it can be possible to try preventing a desired signal cancellation by restricting the performance of the adaptive filters (e.g. leaky LMS, least-mean-square) and/or widening the spatial angle used for blocking. Usually this means that there is a compromise between the desired protection of the desired signal and cancellation of the background noise. The operation of several adaptive methods is also relying on rather advanced control of the adaptive filter. The filter adaptation is only active when the desired signal is not present. This tries to prevent the adaptive filter to adapt to the signal characteristics of the desired signal.

Prior-art solutions are sub-optimal in a sense that they (e.g., leaky LMS adaptive filters) may not provide as good interference cancellation as would be possible without restricting the performance of the adaptive filter. Also, the blocking matrix is conventionally formed as a filter that is calculated as a complement to the beamforming filter and, therefore, changing the look (target) direction of the beamformer requires typically a rather exhaustive recalculation of the complementary filter when the desired signal source moves around. Filtering characteristics of the typical blocking matrix "sub-filters" are usually quite limited in performance, these filters are usually just providing one null towards the source e.g. by subcontracting two parallel microphone signals aligned in phase towards the source direction.

The description of the beamforming filter response as a pair of 2D beamforming filters has been suggested by S. Nordebo et al., "Broadband adaptive beamforming: A design using 2-D spatial filters" Antennas and Propagation Society International Symposium, MI, USA 1993, but this article illustrates the design problem as a generalization of GSC filter design problems and no feasible implementation is described or suggested. In terms of memory efficiency or CPU load the suggested implementation provides no improvement. The memory efficiency in beam steering becomes increasingly important since the order of memory and CPU resources increases linearly with the number of blocking filters $B_i$ as described by Nordebo et al. Direct application of Nordebo et al. method would suggest that complementary filters would be stored in memory, which requires that filter coefficients are stored separately for each look (target) direction. In that case, then, the actual look (target) direction of the beamformer is restricted to the look directions obtained from the pre-calculated filters in the memory. One more alternative is to use pre-steering of the array signals towards the desired signal source (desired signal is in-phase on all channels). However, pre-steering requires either analog delays or digital fractional delay filters, which, in turn, are rather long and therefore complex to implement.

DISCLOSURE OF INVENTION

The object of the present invention is to provide a novel method for efficient beamforming for generalized sidelobe canceling using complementary noise separation filtering for generating a noise reference for adaptation performance of an adaptive interference canceller.

According to a first aspect of the present invention, a method of efficient beamforming for generalized sidelobe canceling using complementary noise separation filtering for generating a noise reference, comprising the steps of: receiving an acoustic signal by a microphone array with M microphones for generating M corresponding microphone signals, wherein M is a finite integer of at least a value of two; generating T+1 intermediate signals and a reference input signal or a preliminary reference input signal in response to said M microphone signals or to M digital microphone signals by T+1 pre-filters and providing the T+1 intermediate signals to a target post-filter and the reference input signal to a complementary adder of a complementary noise separation filter, wherein said T pre-filters and said target post-filter are components of a beamformer and T is a finite integer of at least a value of one; generating a target signal by the target post-filter and providing said target signal to the complementary adder and to an adder of an adaptive interference canceller; and generating a noise reference signal by subtracting the target signal from the reference input signal using the complementary adder and providing said noise reference signal or an equalized noise reference signal to an adaptive filter block of the adaptive interference canceller for performing adaptive noise canceling in the target signal.

In further accord with the first aspect of the invention, the step of generating the noise reference signal may include equalizing said noise reference signal to generate the equalized noise reference signal by an equalization filter block, thus providing the equalized noise reference signal to the adaptive filter block.

Still further according to the first aspect of the invention, prior to the step of generating the T+1 intermediate signals, the method may further comprise the step of: converting the M microphone signals of the microphone array to the M digital microphone signals using an A/D converter and providing said M digital microphone signal to the beamformer. Still further, the step of generating the T+1 intermediate signals may also include providing said T+1 intermediate signals to a speaker tracking block. Yet further, after the step of generating the T+1 intermediate signals, the method may further comprise the steps of: generating a direction of arrival signal by the speaker tracking block and providing said direction of arrival signal to a beam shape control block of the beamformer; and generating a control signal by the beam shape control block and providing said control signal to the target post-filter.

Further still according to the first aspect of the invention, before the step of generating the target signal, the method may further comprise the steps of: generating an external direction of arrival signal by an external control signal generator and providing said direction of arrival signal to a beam shape control block.

In further accordance with the first aspect of the invention, the method may further comprise the steps of: generating a noise cancellation adaptive signal by the adaptive filter block and providing said noise cancellation adaptive signal to the adder; and generating an output target signal using the adder by subtracting the noise cancellation adaptive signal from the target signal. Still further, the output target signal may be provided to the adaptive filter block for continuing an adaptation process and for generating a further value of the output target signal.

Yet further still according to the first aspect of the invention, the beamformer may be a polynomial beamformer.

According still further to the first aspect of the invention, after the step of generating the T+1 intermediate signals, the method may further comprise the step of: generating a control signal by a beam shape control block of the beamformer and providing said control signal to the target post-filter.

According further to the first aspect of the invention, the reference input signal may be generated by a reference input generation filter in response to the preliminary reference input signal.

According still further to the first aspect of the invention, the generalized sidelobe canceling may be performed in a frequency domain, or in a time domain or in both the frequency and the time domain.

According to a second aspect of the invention, a generalized sidelobe canceling system comprises: a microphone array containing M microphones, responsive to an acoustic signal, for providing M microphone signals, wherein M is a finite integer of at least a value of two; a beamformer, responsive to the M microphone signals or to M digital microphone signals for providing T+1 intermediate signals, for providing a reference input signal, for providing a target signal and optionally for providing a complementary reference input signal, wherein T is a finite integer of at least a value of one; a complementary adder of a complementary noise separation filter, responsive to the target signal and to the reference input signal, for providing a noise reference signal; and an adaptive interference canceller, responsive to the target signal, to the noise reference signal or an equalized noise reference signal and to an output target signal, for providing the output target signal.

According further to the second aspect of the invention, the generalized sidelobe canceling system further comprises an A/D converter, responsive to the M microphone signals, for providing the M digital microphone signals;

Further according to the second aspect of the invention, the beamformer may be a polynomial beamformer.

Still further according to the second aspect of the invention, the generalized sidelobe canceling system may further comprise an external control signal generator, for providing the external direction of arrival signal.

According further to the second aspect of the invention, the beamformer comprises: T+1 pre-filters, each responsive to each of the M microphone signals or to each of the M digital microphone signals, for providing the T+1 intermediate signals; a target post-filter, responsive to the T+1 intermediate signals and to a target control signal, for providing the target signal; and a beam shape control block, optionally responsive to a direction of arrival signal or to an external direction of arrival signal, for providing the target control signal. Still further, the generalized sidelobe canceling system may further comprise a speaker tracking block, responsive to the T+1 intermediate signals, for providing the direction of arrival signal.

According still further to the second aspect of the invention, the adaptive interference canceller comprises: an adaptive filter block, responsive to the noise reference signal or to the equalized noise reference signal and to the output target signal, for providing a noise cancellation adaptive signal; and an adder, responsive to the target signal and to the noise cancellation adaptive signals, for providing the output target signal. Still further, the generalized sidelobe canceling system may further comprise an equalization filter block, responsive to the noise reference signals, for providing the equalized noise reference signals.

According further still to the second aspect of the invention, the generalized sidelobe canceling system may further comprise a reference input generation filter, responsive to the preliminary reference input signal, for providing the reference input signal.

Yet still further according to the second aspect of the invention, the generalized sidelobe canceling system may be implemented in a frequency domain, or in a time domain or in both the frequency and the time domain.

According to a third aspect of the invention, a method of efficient beamforming for generalized sidelobe canceling using complementary noise separation filtering for generating a noise reference, comprising the steps of: receiving an acoustic signal by a microphone array with M microphones for generating M corresponding microphone signals, wherein M is a finite integer of at least a value of two; generating T+1 intermediate signals and a reference input signal or a preliminary reference input signal in response to the M microphone signals or to M digital microphone signals by T+1 pre-filters and providing the T+1 intermediate signals to each of K target post-filters and the reference input signal or a corresponding one of K individual reference input signals to a corresponding one of K complementary adders) of a corresponding one of K complementary noise separation filters, wherein said T pre-filters and said K target post-filter are components of a beamformer, K is a finite integer of at least a value of one and T is a finite integer of at least a value of one; generating K target signals by the K target post-filters and providing each of said K target signals, to a corresponding one of the K complementary adders, respectively, and to a corresponding one of K adders of a corresponding one of K adaptive interference cancellers; and generating K noise reference signals by subtracting each of the target signals from the reference input signal or from the corresponding one of the K individual reference input signals using a corresponding one of the K complementary adders, respectively, and providing each of said K noise reference signals or each of K equalized noise reference signals to a corresponding one of the K adaptive filter blocks of the corresponding one of the K adaptive interference cancellers, respectively, for performing adaptive noise canceling in a corresponding one of the K target signals.

According further to the third aspect of the invention, the step of generating the K noise reference signals may include equalizing each of said K noise reference signals by a corresponding one of K equalization filter blocks for generating a corresponding one of the equalized noise reference signals, and providing said corresponding one of the K equalized noise reference signal to the corresponding one of the K adaptive filter blocks.

Further according to the third aspect of the invention, prior to the step of generating the T+1 intermediate signals, the method may further comprise the step of converting the M microphone signals of the microphone array to the M digital microphone signals using an A/D converter and providing said M digital microphone signals to the beamformer.

Still further according to the third aspect of the invention, the step of generating the T+1 intermediate signals may also include providing said T+1 intermediate signals to a speaker tracking block. Still further, after the step of generating the T+1 intermediate signals, the method may further comprise the steps of: generating K direction of arrival signals by the speaker tracking block and providing each of said K direction of arrival signals to a corresponding one of K beam shape control blocks of the beamformer; and generating one of K control signals by the corresponding one of the K beam shape control blocks and providing each of said K control signals to a corresponding one of the K target post-filters.

According further to the third aspect of the invention, the method further comprises the steps of: generating one of K noise cancellation adaptive signals by a corresponding one of the K adaptive filter blocks and providing each of said K noise cancellation adaptive signals to the corresponding one of the K adders; and generating each of K output target signals using the corresponding one of the K adders by subtracting the corresponding one of the K noise cancellation adaptive signals from the corresponding one of the target signals. Still further, each of the output target signals is provided to the corresponding one of the K adaptive filter blocks for continuing an adaptation process and for generating further values of the corresponding K output target signals.

According still further to the third aspect of the invention, the reference input signal or the K individual reference input signals may be generated by a reference input generation filter in response to the preliminary reference input signal and optionally in response to the corresponding direction of arrival signals.

According further still to the third aspect of the invention, before providing each of the K noise reference signals to the corresponding one of the K adaptive filter blocks, the step of generating the K noise reference signals also includes equalizing each of said K noise reference signals for generating a corresponding one of the K equalized noise reference signals by a corresponding one of the K equalization filter blocks, and providing the corresponding one of the K equalized noise reference signals to the corresponding one of the K adaptive filter blocks.

Yet still further according to the third aspect of the invention, the method may further comprise the step of post-processing of the K output target signals by a post-processing block for generating P output system signals, wherein P output system signals are various combinations of the K output target signals and P is a finite integer of at least a value of one.

Yet further still according to the third aspect of the invention, the beamformer may be a polynomial beamformer. Still further, the generalized sidelobe canceling may be performed in a frequency domain, or in a time domain or in both the frequency and the time domain.

According to a fourth aspect of the invention, a generalized sidelobe canceling system comprises: a microphone array containing M microphones, responsive to an acoustic signal, for providing M microphone signals, wherein M is a finite integer of at least a value of two; a beamformer, responsive to the M microphone signals or to M digital microphone signals for providing T+1 intermediate signals, for providing a reference input signal, for providing K target signals, optionally for providing a complementary reference input signal and optionally for providing K individual reference input signal, wherein T is a finite integer of at least a value of one, and K is a finite integer of at least a value of one; K complementary adders of corresponding K complementary noise separation filters, each responsive to a corresponding one of the respective K target signals, and to the reference input signal or optionally to a corresponding one of the K individual reference input signal, each for providing a corresponding one of K noise reference signals; and K adaptive interference cancellers, each responsive to the corresponding one of the respective K target signals, to the corresponding one of the K noise reference signal or a corresponding one of K equalized noise reference signal and to a corresponding one of K output target signals, respectively, each for providing a corresponding one of the K output target signals.

According further to the fourth aspect of the invention, the generalized sidelobe canceling system may further comprise K equalization filter blocks, each responsive to the corresponding one of the K noise reference signal, for providing the corresponding one of the K equalized noise reference signal.

Further according to the fourth aspect of the invention, the generalized sidelobe canceling system may further comprise a post-processing block, responsive to the K output target signals, for providing P output system signals, wherein P is a finite integer of at least a value of one. Still further, the post-processing block may be a mixer or a conference/switch bridge. Yet still further, the post-processing block may contain a processing block and a control block.

Still further according to the fourth aspect of the invention, the generalized sidelobe canceling system may be implemented in a frequency domain, or in a time domain or in both the frequency and the time domain.

According further to the fourth aspect of the invention, the generalized sidelobe canceling system may further comprise a reference input generation filter, responsive to the preliminary reference input signal or optionally to corresponding K directions of arrival signals, for providing the reference input signal or optionally the K individual reference input signals.

It is advantageous in the present invention that, by using a polynomial beamforming filter structure described in PCT Patent Application "System and Method for Processing a Signal Being Emitted from a Target Signal Source into a Noisy Environment" by M. Kajala, M. Hämäläinen., it provides the complementary beam output signal without increasing the computational complexity of the algorithm. For a typical polynomial beamformer this means that the complementary filter requires around ¼% of the CPU load of the primary beam former H(z). The invention provides complementary beamformer filters without designing or storing beamformer coefficients for the beamformer H(z) (desired) and the complementary beamformer 1-H(z) (background) separately. The efficient complementary filter design has an inherent support for beam steering and target tracking applications because the complementary beam is tracking the desired look direction in synchrony with the filter and sum beamformer. No additional memory or CPU overhead is needed for separate steering of the complementary beam. According to the present invention, the proposed method provides a very efficient implementation for filter and sum beamformer front-end. Also, the present invention can be generalized to tracking of multiple targets and sources by driving the polynomial beamformer filter with multiple post-filters with corresponding steering variables.

BRIEF DESCRIPTION OF THE DRAWINGS

For a better understanding of the nature and objects of the present invention, reference is made to the following detailed description taken in conjunction with the following drawings, in which.

BEST MODE FOR CARRYING OUT THE INVENTION

Figure 1:
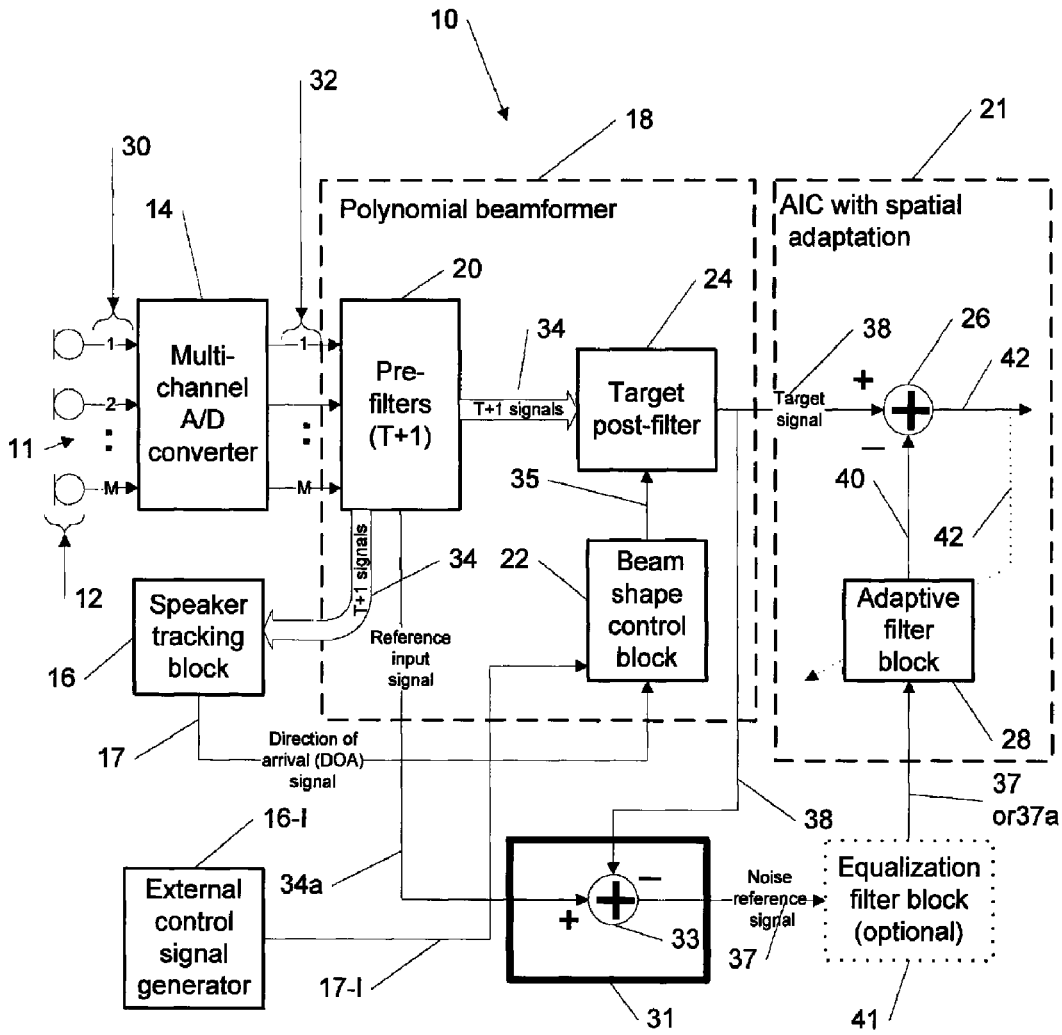
FIG. 1 is a block diagram representing an example of generalized sidelobe canceling with efficient beamforming using a complementary noise separation filter, according to the present invention.

The present invention provides a novel method for efficient beamforming for generalized sidelobe canceling using complementary noise separation filtering for generating a noise reference for adaptation performance of an adaptive interference canceller (AIC). This invention illustrates an approach how the beamformer performance can be efficiently improved by efficient integration of a complementary filter and sum beamforming and adaptive processing. Like all beamformer systems this invention is targeted to extract the desired signal from the look (target) direction and try to attenuate the disturbing noise components.

According to the present invention, the adaptive filter provides noise estimates to be subtracted from the desired signal path providing further noise reduction in the system output. More specifically, the present invention relates to a multi-microphone beamforming system similar to a generalized sidelobe canceller (GSC) structure, but the difference to the conventional GSC method is that the complementary filter used for desired signal blocking can be realized with a simple subtraction without compromising the beam steering flexibility of the polynomial beamforming filter front end. This approach provides the calculation of complementary filter and sum beamformer output signals using the desired target signal and the complementary background noise estimate signal, respectively, with the complexity of one complementary filter and a sum beamformer. For adaptive post-processing this provides a very efficient method for a source separation where the signal originating from the desired look (target) direction is separated from its background.

According to the present invention, there is an essential difference in the method of generating the noise reference signal for the adaptive interference canceller (AIC). Also, when the desired signal source moves around, the beam direction needs to be changed. Using a polynomial beamforming structure in one possible scenario among others as described in European Patent No. 1184676 "A method and a Device for Parametric Steering of a Microphone Array Beamformer" by M. Kajala and M. Hämäläinen (corresponding PCT Patent Application publication WO 02/18969), referred to as Kajala et al.), together with speaker tracking described in U.S. Pat. No. 6,449,593, "Method and System for Tracking Human Speakers" by P. Valve, the system knows the desired signal source direction and provides two signal outputs: one for the main beam for picking up a sound from the desired speech direction (target or look direction) and another one, based on this invention, that is the complement of the main beam and further used as for the noise reference for the adaptive interference canceller (AIC). The complement signal has a spatial zero in the look direction and, thus, the desired signal is rejected from the AIC filter input. The two beams, namely the main beam and the complementary "antibeam" are both obtained by changing only one parameter value in the system (e.g., D in Kajala et al.). Also, the present invention can be generalized to tracking of multiple targets and sources by driving the polynomial beamformer filter with multiple post-filters with corresponding steering variables.

FIG. 1 is a block diagram representing one scenario among others of a generalized sidelobe canceling with efficient beamforming for generating a noise reference signal 37 using a complementary noise separation filter in a generalized sidelobe canceling system 10, according to the present invention.

An acoustic signal 11 is received by a microphone array 12 with M microphones for generating M corresponding microphone (electro-acoustical) signals 30, wherein M is a finite integer of at least a value of two. Typically, the microphones in the microphone array 12 are arranged in a single array substantially along a horizontal line. However, the microphones can be arranged along a different direction, or in a 2D or 3D array. The M corresponding microphone signals 30 can be converted to digital signals 32 using an A/D converter 14 and each of said M digital microphone signals 32 is provided to each of T+1 pre-filters 20 of a polynomial beamformer 18, wherein T is a finite integer of at least a value of one. Operation of the polynomial beamformer 18 and its components including T+1 pre-filters 20, a target post-filter 24 and a beam shape control block 22 are described in detail in European Patent No. 1184676 "A method and a Device for Parametric Steering of a Microphone Array Beamformer" by M. Kajala and M. Hämäläinen. (corresponding PCT Patent Application publication WO 02/18969). Thus, the performance of the polynomial beamformer 18 and its components are incorporated here by reference (see FIG. 4 and operation of the beamformer 30-II of the above reference).

The T+1 pre-filters 20 generate T+1 intermediate signals 34 and a reference input signal 34*a* in response to said M digital microphone signals 32 and provide T+1 intermediate signals 34 to the target post-filter 24 and the reference input signal 34*a* to a complementary adder 33 of a complementary noise separation filters 31, as discussed below in detail. Said T+1 pre-filters 20 and said target post-filter 24 are components of the beamformer 18. Said T+1 intermediate signals 34 are also provided to a speaker tracking block 16 by the T+1 pre-filters 20.

The T intermediate signals 34 still contain the spatial information of the M microphone signals 30 but in a different format. These T+1 intermediate signals 34 need to be further processed by the target post-filter 24, in order to achieve the signal that properly represents the look (target) direction specified by a direction control signal 35 that are generated by a beam shape control block 22 as discussed below.

The performance of the speaker and noise tracking block 16 is described in U.S. Pat. No. 6,449,593 "Method and System for Tracking Human Speakers" by P. Valve and incorporated here by reference (see FIG. 3 of the above reference). The speaker tracking block 16 is primarily used to select a favorable beam direction to track the speaker by generating a direction of arrival (DOA) signal 17 and providing said DOA signal 17 to the beam shape control block 22 (its performance is incorporated here by reference as stated above) of the polynomial beamformer 18. The speaker tracking block 16 is able to trace a desired target signal source direction as discussed below. The beam shape control block 22 generates a target control signal 35 and provides said control signal 35 to the target post-filter 24.

There are other methods, which can be used for generating the direction of arrival signal 17. It is noted that, according to the present invention, the location of the target signal source, i.e. forming the control signal 35, can be determined by checking the visual information obtained from a camera (if there is one attached to the system 10) or by any other means that can give the required information instead of using the speaker tracking block 16. Alternatively, an external control signal generator 16-I can be used instead of the block 16 for generating an external direction of arrival signal 17-I instead of the signal 17, respectively. The difference is that the block 16-I operates independently and does not require said T+1 intermediate signals 34 for its operation.

The reference input signal 34*a* can be generated in different ways: as an output signal of a constant (non-steered) filter and in a valuable special case as just a delayed microphone signal. Preferably the reference input signal 34*a* has a flat frequency response to all directions for symmetric steering and the signal arrival delay is constant for all desired directions (symmetric array). If the delay for the signals 34*a* and 38 is identical for all desired directions, then the noise reference signal 37 is also in phase with the target signal 38. In such situation the adaptive filter block is not disturbed by undesirable delay fluctuations introduced by the beam steering. Depending on array geometry the actual implementation may differ. One implementation can use an acoustic center of the steerable beamformer. The fractional delay processing in the polynomial beamformer will preferably perform the delay adjustments relative to the acoustic center of the beamformer.

The acoustic center is the point in the spatial-temporal sampling grid of the microphone array 12 that has the same group delay for signals arriving from different directions. In practical array configurations, an ideal acoustic center can be difficult to define, fortunately the method described in this invention is not sensitive to exact location of the acoustic center.

The acoustic center can be either one point in the microphone array (spatial-temporal) sampling grid or a "virtual" center that is generated using a filter approximation. For example, a symmetric 4-mic Y shape filter can use the delayed output of the center microphone as the acoustic center, but a 3-mic array having a shape of equilateral triangle can use as the acoustic center an average of all input microphone signals. The 4-mic design is more preferable because averaging produces a low-pass filtering effect, which means that the complement beam has high pass characteristics. If the microphone geometry has no microphone located in the acoustic center of the array 12, the reference input signal can be either approximated using a fixed impulse response filter as discussed below or selecting an off-center microphone output as a reference input signal. Asymmetric microphone selection can cause asymmetric beams and the compensation of asymmetric geometry can result in asymmetric beamforming filters in possible beamforming filter optimization.

For example, in a special case when the array geometry has a microphone (L) located in the acoustic center and a pre-filter length (S) is odd (S=2J+1), the reference input signal 34*a* can be taken directly as a delayed (index J+1) signal of the center microphone (L). However, in general a microphone number does not limit the possibility of collating the microphone in the acoustic center. For example, a Y-shaped microphone array has 4 microphones and the center microphone can be in the acoustic center. Also an X-shaped 5-microphone array can have microphone located in the acoustic center.

Further processing proceeds as follows. The target post-filter 24 generates a target signal 38 using the target control signal 35 and provides said target signal 38 to an adder 26 of the adaptive interference canceller (AIC) 21 and to the complementary adder 33 of the complementary noise separation filter 31. The complementary adder 33 generates the noise reference signal 37, which is the complement of the target signal 38 and further used as a noise reference for the AIC 21. When the target signal has a unity response to a target signal direction, the noise reference signal 37 has a spatial zero in the look (target) direction and, thus, the desired signal is rejected from the input signal of an adaptive filter block 28 of the AIC 21.

Typically, said noise reference signal 37 does not have a flat spectrum, this can lead to colored reference signal. This problem can be compensated using different methods known in the art. A more suitable adaptive filter technology can be used. Spectral whitening techniques have been used successfully to improve the adaptation performance. Another simple method, as shown in the example of FIG. 1, is using simple equalization filtering of the noise reference signal 37. An equalization filter block 41 can be optionally used as shown in FIG. 1, such that before providing the noise reference signal 37 to the adaptive filter block 28 of the AIC 21, the block 41 can be used to correct the spectral shaping of the noise reference signal 37 or produce spectral weighting characteristics for the adaptive filter block 28. This spectral shaping method is known in the art but its utilization for compensating the noise reference signal spectrum (originating from the non-ideal sampling of the acoustic center signal) is novel, according to the present invention. Thus the noise reference signal 37 or the equalized noise reference signal 37*a* is provided to the adaptive filter block 28.

The adaptive filter block 28 generates a noise cancellation adaptive signal 40 and provides it to the adder 26. The adder 26 generates the output target signal 42 of the generalized sidelobe canceling system 10 by subtracting the signal 40 from the target signal 38 and the output target signal 42 is provided as a feedback to a coefficient adaptation block (not shown in FIG. 1) of the respective adaptive filter block 28, thus accomplishing spatial adaptation of the target signal 38.

Figure 2:
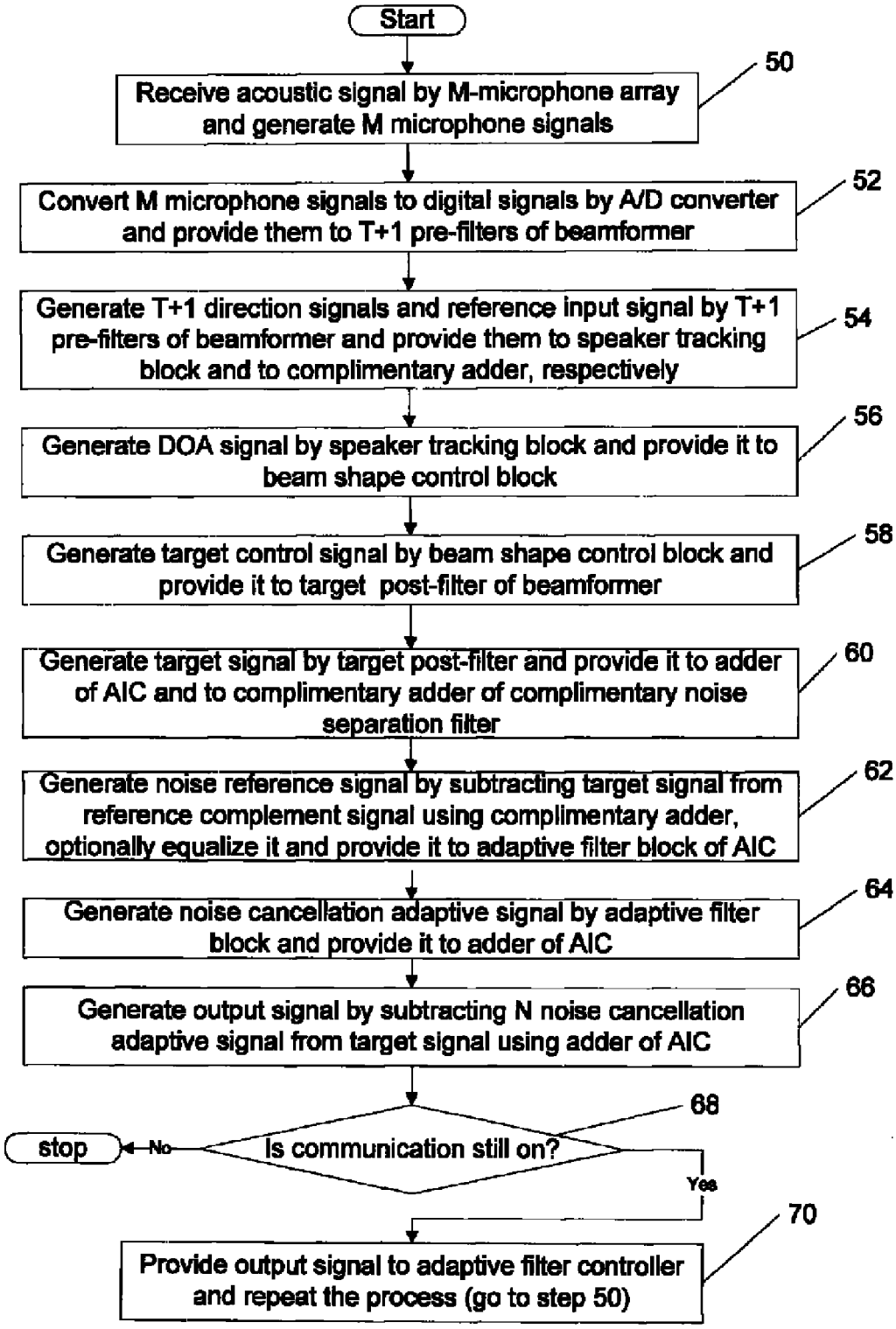
FIG. 2 is a flow chart of generalized sidelobe canceling with efficient beamforming using a complementary noise separation filter, according to the present invention.

FIG. 2 shows a flow chart of generalized sidelobe canceling with efficient beamforming using complementary noise separation filter 31 for the example of FIG. 1, according to the present invention. The flow chart of FIG. 2 only represents one possible scenario among others. In a method according to the present invention, in a first step 50, the acoustic signal 11 is received by the M-microphone array 12 and the M microphone signals 30 are generated by said array 12. In a next step 52, the multi-channel A/D converter 14 converts the M microphone signals 30 to the M digital microphone signals 32 and provides them to each of the T+1 pre-filters 20 of the polynomial beamformer 18.

In a next step 54, the T intermediate signals 34 are generated by the T+1 pre-filters 20 of the beamformer 18 and provided to the speaker tracking block 16 and to the target post-filter 24, and the reference input signal 34*a* is generated by the T+1 pre-filters 20 and provided to the complementary adder 33, respectively.

In a next step 56, the speaker tracking block 16 generates the direction of arrival (DOA) signal 17 and provides the signal 17 to the beam shape control block 22. In a next step 58, the target control signal 35 is generated by the beam shape control block 22 and provided to the target post-filter 24 of the beamformer 18. In a next step 60, the target signal 38 is generated by the target post-filter 24 and provided to the adder 26 of the AIC 21 and to the complementary adder 33. In a next step 62, the noise reference signal 37 is generated by subtracting the target signal 38 from the reference input signal 34*a* using the complementary adder 33, and then optionally the noise reference signal 37 is equalized using the equalization filter block 41, thus the noise reference signal 37 or alternatively the equalized noise reference signal 37*a* is provided to the adaptive filter block 28 of the AIC 21.

In a next step 64, the cancellation adaptive signal 40 is generated by the adaptive filter block 28 of the AIC 21 and provided to the adder 26. In a next step 66, the output target signal 42 is generated by the adder 26 by subtracting the noise cancellation adaptive signal 40 from the target signal 38. In a next step 68, it is ascertained whether the communication is still on. If that is not the case, the process stops. If, however, the communication is still on, in a next step 70, the output target signal 42 is provided as a feedback to a coefficient adaptation block (not shown in FIG. 1) of the adaptive filter block 28 and the process goes back to step 50.

Figure 3:
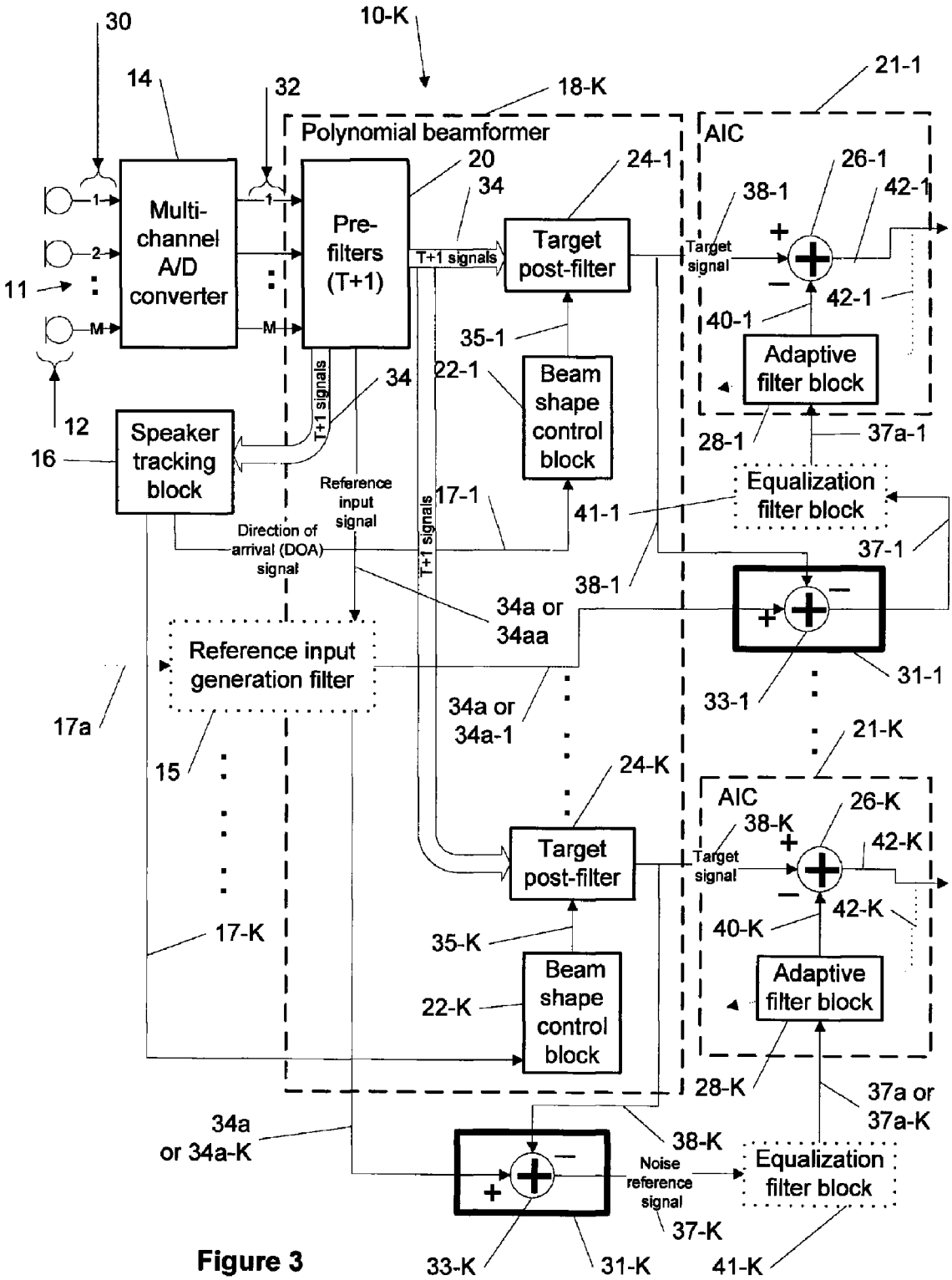
FIG. 3 is a block diagram representing an example of generalized sidelobe canceling with efficient beamforming using multiple complementary noise separation filters for processing of multi-target directional signals, according to the present invention.

FIG. 3 is a block diagram representing one example among others of generalized sidelobe canceling with efficient beamforming using multiple complementary noise separation filters for processing of multi-target directional signals, according to the present invention. The performance of the system of FIG. 3 is similar to the performance of the system of FIG. 1 except there are K look (target) directions instead of one such direction in the example of FIG. 1 (K is an integer of least value of one).

The polynomial beamformer 18-K of FIG. 3 has K target post-filters 24-1, 24-2, . . . , 24-K, K complementary adders 33-1, 33-2, . . . , 33-K of K respective complementary noise separation filters 31-1, 33-2, . . . , 3-K, -K, K beam shape control blocks 22-1, 22-2, . . . , 22-K, and optionally K equalization filter blocks 41-1, 41-2, . . . , 41-K, respectively. Also, instead of one, as in FIG. 1, there are K AICs 21-1, 21-2, . . . , 21-K with K adaptive filter blocks 28-1, 28-2, . . . , 28-K and K adders 26-1, 26-2, . . . , 26-K, respectively. Thus, instead of one DOA signal, the speaker tracking block 16 generates K DOA signals 17-1, 17-2, . . . , 17-K, respectively, each of which is sent to a corresponding one of the K beam shape control blocks 22-1-1, 22-1-2, . . . , 22-1-K. Each of the K beam shape control blocks 22-1, 22-2, . . . , 22-K generates and provides a corresponding one of K target control signals 35-1, 35-2, . . . , 35-K to a corresponding one of the K target post-filters 24-1, 24-2, . . . , 24-K, respectively. Each of the K target post-filters 24-1, 24-2, . . . , 24-K generates and sends a corresponding one of the corresponding K target signals 38-1, 38-2, . . . , 38-K to a corresponding one of the K adders 26-1, 26-1, . . . , 26-K and to a corresponding one of the K complementary adders 33-1, 33-2, . . . , 33-K, respectively.

Each of the respective (2-input) K complementary adders 33-1, 33-2, . . . , 33-K generates a corresponding one of the K noise reference signals 37-1, 37-2, . . . , 37-K, which is a complement of the corresponding one of the K target signals 38-1, 38-2, . . . , 38-K and is further used as a noise reference for a corresponding one of the K AICs 21-1, 21-2, . . . , 21-K. As it is described above, each of the K noise reference signals 37-1, 37-2, . . . , 37-K can be optionally equalized by a corresponding one of the K respective equalization filters blocks 41-1, 41-2, . . . , 41-K for generating a corresponding one of K equalized noise reference signals 37*a*-1, 37*a*-2, . . . , 37*a*-K.

Thus, each of the K noise reference signals 37-1, 37-2, . . . , 37-K or each of the equalized noise reference signals 37*a*-1, 37*a*-2, . . . , 37*a*-K is provided to a corresponding one of the corresponding adaptive filter blocks 28-1-1, 28-1-2, . . . , 28-1-K, respectively. Each of the adaptive filter blocks 28-1-1, 28-1-2, . . . , 28-1-K generates a corresponding one of K noise cancellation adaptive signals 40-1, 40-2, . . . , 40-K and provides the corresponding one of the K noise cancellation adaptive signals 40-1, 40-2, . . . , 40-K signals 40-1, 40-2, . . . , 40-K to the corresponding one of the corresponding K adders 26-1, 26-1, . . . , 26-K. Each of the K adders 26-1, 26-1, . . . , 26-K generates a corresponding one of K output target signals 42-1, 42-2, . . . , 42-K of the generalized sidelobe canceling system 10 by subtracting the corresponding one of the K noise cancellation adaptive signals 40-1, 40-2, . . . , 40-K from the corresponding one of the K target signals 38-1, 38-2, . . . , 38-K, respectively, and providing each of the K output target signals 42-1, 42-2, . . . , 42-K as a feedback to a corresponding one of K corresponding coefficient adaptation blocks (not shown in FIG. 1) of a corresponding one of the respective K adaptive filter blocks 28-1, 28-2, . . . , 28-K, thus accomplishing spatial adaptation of each of the K target signals 38-1, 38-2, . . . , 38-K.

Figure 4:
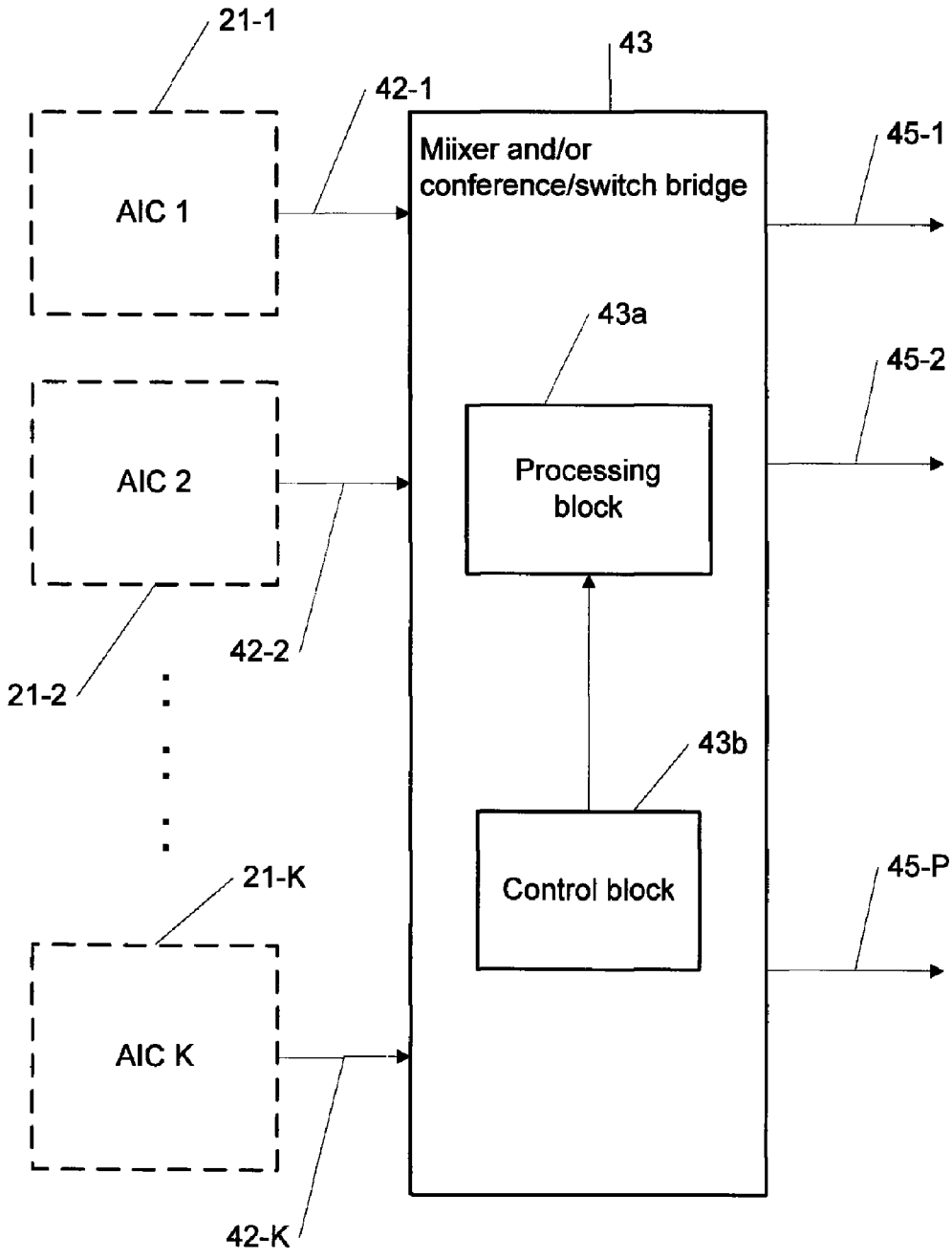
FIG. 4 is a block diagram representing an example of post-processing of output multi-target signals of a generalized sidelobe canceller with efficient beamforming using complementary noise separation filters, according to the present invention.

In the case of K channel generalized sidelobe canceling system 10-K, each AIC block 28-1, 28-2, . . . , 28-K uses a complementary signal pair 38-1, 38-2, . . . , 38-K and 37-1, 37-2, . . . , 37-K trying to eliminate all signal components of 37-1, 37-2, . . . , 37-K from the corresponding output target signals 42-1, 42-2, . . . , 42-K, respectively. This means that generalized sidelobe canceling system 10-K is only looking at one direction and signals coming from other directions are attenuated as a noise. If the application requires parallel recording of multiple signal sources, different output signals can be need to be combined. Therefore, further processing of the K output target signals 42-1, 42-2, . . . , 42-K can include combining and/or intermixing them (whatever application requires) using additional components such as a mixer and/or a conference switch/bridge 43 and generating P output system signals 45-1, 45-2, . . . , 45-P as shown in FIG. 4, wherein P is an integer of at least a value of one. These technologies are well-known in the art. Typically the block 43 includes a processing block 43*a* and a control block 43*b*.

FIG. 1 represents just one example for implementing the present invention. There are other variations and possible scenarios. For example, the reference input signal 34*a* can be generated individually as corresponding individual reference input signals 34*a*-1, 34*a*-2, . . . , 34*a*-K for corresponding K target directions and provided to the corresponding complementary adders 33-1, 33-2, . . . , 33 as shown in FIG. 3.

In another related scenario, an additional reference input generation filter 15 can be used for generating said reference input signal 34*a* or optionally for generating the K individual reference input signals 34*a*-1, 34*a*-2, . . . , 34*a*-K using a preliminary reference signal 34*aa* as an input instead of the signal 34*a* as also shown in FIG. 3. In the case of generating the individual reference input signals 34*a*-1, 34*a*-2, . . . , 34*a*-K, the reference input generation filter 15 can optionally use corresponding directions of arrival signals 17-1, 17-2, . . . 17-K as additional inputs. This scenario is a generalization of the special case of selecting a delayed impulse (delayed input selection). Input signal selection is naturally preferable because of a reduced computational complexity. However, in certain applications the approach of using the reference input generation filter 15 as a special case of the 2D filter for generating said reference input signal 34*a* or optionally the K individual reference input signals 34*a*-1, 34*a*-2, . . . , 34*a*-K can be justified, especially in the case of many look (target) directions and because of a desirability of generating the common reference input signal 34*a* only once for all said target directions.

The reference input generation filter 15 can be preferably implemented by approximating a two dimensional Kronecker delta function at the acoustic center of the microphone array 12. The impulse response of the reference input generation filter 15 can be defines as follows. When the input is two dimensional Kronecker delta function at location (m', n'), the impulse response is defined as $h(m, n; m', n')=H(\delta(m-m', n-n'))$. The semicolon (;) is used to separate input and output pairs of coordinates. Ideally, when the input sampling grid having a location (m', n') is aligned with the acoustic center, the impulse response can be approximated by $h(m, n; m', n')=\delta(m-m', n-n')$, the Kronecker delta function. If H(.) has non-ideal filtering characteristics then the complementary filter 1-H(.) is automatically affected by H(.).

It is also noted that the present invention demonstrated by the examples of FIGS. 1 through 4 can be implemented in a frequency domain or in a time domain or in both domains.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A method, comprising:

receiving an acoustic signal for generating M corresponding microphone signals, wherein M is a finite integer of at least a value of two;

generating T+1 intermediate signals and a reference input signal in response to said M microphone signals or to M digital microphone signals by a beamformer and providing the T+1 intermediate signals to a target post-filter of the beamformer and the reference input signal to a complementary adder of a complementary noise separation filter, wherein T is a finite integer of at least a value of one;

generating a target signal by the target post-filter and providing said target signal to the complementary adder and to an adder of an adaptive interference canceller;

generating a noise reference signal by subtracting the target signal from the reference input signal using the complementary adder and providing said noise reference signal or an equalized noise reference signal to an adaptive filter block of the adaptive interference canceller for providing an output target signal by performing adaptive noise canceling in the target signal by the adaptive interference canceller to provide generalized sidelobe canceling;

generating a noise cancellation adaptive signal by the adaptive filter block and providing said noise cancellation adaptive signal to the adder; and generating said output target signal using the adder in the adaptive interference canceller by subtracting the noise cancellation adaptive signal from the target signal, wherein the output target signal is provided to the adaptive filter block for continuing an adaptation process and for generating a further value of the output target signal.

2. The method of claim 1, wherein the generating the noise reference signal comprises equalizing said noise reference signal to generate the equalized noise reference signal by an equalization filter block for providing the equalized noise reference signal to the adaptive filter block.

3. The method of claim 1, wherein prior to the generating the T+1 intermediate signals, the method further comprises:

converting the M microphone signals to the M digital microphone signals using a converter and providing said M digital microphone signals to the beamformer.

4. The method of claim 1, wherein the generating the T+1 intermediate signals also comprises providing said T+1 intermediate signals to a speaker tracking block and wherein, after the generating the T+1 intermediate signals, the method further comprises:

generating a direction of arrival signal by the speaker tracking block and providing said direction of arrival signal to a beam shape control block of the beamformer; and generating a target control signal in response to said direction of arrival signal by the beam shape control block and providing said target control signal to the target post-filter for generating said target signal using said T+1 intermediate signals and said target control signal.

5. The method of claim 1, wherein before the generating the target signal, the method further comprises:

generating an external direction of arrival signal by an external control signal generator and providing said external direction of arrival signal to a beam shape control; and generating a target control signal in response to said external direction of arrival signal by the beam shape control block and providing said target control signal to the target post-filter for generating said target signal using said T+1 intermediate signals and said target control signal.

6. The method of claim 1, wherein the beamformer is a polynomial beamformer.

7. The method of claim 1, wherein after the generating the T+1 intermediate signals, the method further comprises:

generating a target control signal by a beam shape control block of the beamformer and providing said target control signal to the target post-filter.

8. The method of claim 1, wherein the reference input signal is generated by a reference input generation filter in response to a preliminary reference input signal.

9. The method of claim 1, wherein the generalized sidelobe canceling is performed in a frequency domain, or in a time domain or in both the frequency and the time domain.

10. Apparatus comprising:

a beamformer, responsive to M microphone signals or to M digital microphone signals, configured to provide T+1 intermediate signals, configured to provide a reference input signal, configured to provide a target signal in response to the T+1 intermediate signals, wherein T is a finite integer of at least a value of one and M is a finite integer of at least a value of two;

a complementary adder of a complementary noise separation filter, responsive to the target signal and to the reference input signal, configured to provide a noise reference signal by subtracting the target signal from the reference input signal;

an adaptive interference canceller, responsive to the target signal and to the noise reference signal or an equalized noise reference signal, configured to provide an output target signal;

an adaptive filter block configured to generate a noise cancellation adaptive signal and provide said noise cancellation adaptive signal to an adder in the adaptive interference canceller, the adder configured to generate said output target signal in the adaptive interference canceller by subtracting a noise cancellation adaptive signal from the target signal, wherein the output target signal is provided to the adaptive filter block for continuing an adaptation process and for generating a further value of the output target signal.

11. The apparatus of claim 10, further comprising:

an A/D converter, responsive to the M microphone signals, configured to provide the M digital microphone signals.

12. The apparatus of claim 10, wherein the beamformer is a polynomial beamformer.

13. The apparatus of claim 10, further comprising:

an external control signal generator, f configured to provide an external direction of arrival signal.

14. The apparatus of claim 10, wherein the beamformer comprises:

T+1 pre-filters, each responsive to each of the M microphone signals or to each of the M digital microphone signals, configured to provide the T+1 intermediate signals;

a target post-filter, responsive to the T+1 intermediate signals and to a target control signal, configured to provide the target signal; and a beam shape control block, responsive to a direction of arrival signal or to an external direction of arrival signal, configured to provide the target control signal.

15. The apparatus of claim 14, further comprising:

a speaker tracking block, responsive to the T+1 intermediate signals, configured to provide the direction of arrival signal.

16. The apparatus of claim 10, wherein the adaptive interference canceller comprises:

an adaptive filter block, responsive to the noise reference signal or to the equalized noise reference signal and to the output target signal, configured to provide a noise cancellation adaptive signal; and an adder, responsive to the target signal and to the noise cancellation adaptive signals, configured to provide the output target signal.

17. The apparatus of claim 16, further comprising:

an equalization filter block, responsive to the noise reference signal, configured to provide the equalized noise reference signals.

18. The apparatus of claim 10, further comprising:

a reference input generation filter, responsive to a preliminary reference input signal, configured to provide the reference input signal.

19. The apparatus of claim 10, wherein said generalized sidelobe canceling system is implemented in a frequency domain, or in a time domain or in both the frequency and the time domain.

20. The apparatus of claim 10, further comprising a microphone array containing M microphones, responsive to an acoustic signal, configured to provide the M microphone signals.

21. A method, comprising:

receiving an acoustic signal for generating M corresponding microphone signals, wherein M is a finite integer of at least a value of two;

generating T+1 intermediate signals and a reference input signal in response to M microphone signals or to M digital microphone signals by a beamformer and providing the T+1 intermediate signals to each of K target post-filters of the beamformer and the reference input signal or a corresponding one of K individual reference input signals to a corresponding one of K complementary adders of a corresponding one of K complementary noise separation filters, wherein K is a finite integer of at least a value of one and T is a finite integer of at least a value of one and M is a finite integer of at least a value of two;

generating K target signals by the K target post-filters of the beamformer and providing each of said K target signals, to a corresponding one of the K complementary adders, respectively, and to a corresponding one of K adders of a corresponding one of K adaptive interference cancellers;

generating K noise reference signals by subtracting each of the target signals from the reference input signal or from the corresponding one of the K individual reference input signals using a corresponding one of the K complementary adders, respectively, and providing each of said K noise reference signals or each of K equalized noise reference signals to a corresponding one of K adaptive filter blocks of the corresponding one of the K adaptive interference cancellers, respectively, for providing each of K output target signals by performing adaptive noise canceling in a corresponding one of the K target signals by the corresponding one of the K adaptive filter blocks to provide generalized sidelobe canceling;

generating one of K noise cancellation adaptive signals by a corresponding one of the K adaptive filter blocks and providing each of said K noise cancellation adaptive signals to the corresponding one of the K adders; and generating said each of the K output target signals using the corresponding one of the K adders by subtracting the corresponding one of the K noise cancellation adaptive signals from the corresponding one of the target signals, wherein said each of the output target signals is provided to the corresponding one of the K adaptive filter blocks for continuing an adaptation process and for generating further values of the corresponding K output target signals.

22. The method of claim 21, wherein the generating the K noise reference signals comprises equalizing each of said K noise reference signals by a corresponding one of K equalization filter blocks for generating a corresponding one of the equalized noise reference signals, and providing said corresponding one of the K equalized noise reference signal to the corresponding one of the K adaptive filter blocks.

23. The method of claim 21, wherein prior to the generating the T+1 intermediate signals, the method further comprises:

converting the M microphone signals to the M digital microphone signals using an A/D converter and providing said M digital microphone signals to the beamformer.

24. The method of claim 21, wherein the generating the T+1 intermediate signals also comprises providing said T+1 intermediate signals to a speaker tracking block, and wherein, after the generating the T+1 intermediate signals, the method further comprises:

generating K direction of arrival signals by the speaker tracking block and providing each of said K direction of arrival signals to a corresponding one of K beam shape control blocks of the beamformer; and generating one of K target control signals by the corresponding one of the K beam shape control blocks in response to the each of said K direction of arrival signals and providing each of said K target control signals to a corresponding one of the K target post-filters for generating one of K target control signals using said T+1 intermediate signals and said one of the K target control signals.

25. The method of claim 21, wherein the reference input signal or the K individual reference input signals are generated by a reference input generation filter in response to a preliminary reference input signal.

26. The method of claim 21, wherein, before providing each of the K noise reference signals to the corresponding one of the K adaptive filter blocks, the generating the K noise reference signals also comprises equalizing each of said K noise reference signals for generating a corresponding one of the K equalized noise reference signals by a corresponding one of the K equalization filter blocks, and providing the corresponding one of the K equalized noise reference signals to the corresponding one of the K adaptive filter blocks.

27. The method of claim 21, further comprising:

post-processing of the K output target signals by a post-processing block for generating P output system signals, wherein P output system signals are various combinations of the K output target signals and P is a finite integer of at least a value of one.

28. The method of claim 21, wherein the beamformer is a polynomial beamformer.

29. The method of claim 21, wherein the generalized sidelobe canceling is performed in a frequency domain, or in a time domain or in both the frequency and the time domain.

30. Apparatus comprising:

a beamformer, responsive to M microphone signals or to M digital microphone signals configured to provide T+1 intermediate signals, configured to provide a reference input signal or K individual reference input signals, configured to provide K target signals, wherein T is a finite integer of at least a value of one, and K is a finite integer of at least a value of one and wherein M is a finite integer of at least a value of two;

K complementary adders of corresponding K complementary noise separation filters, each responsive to a corresponding one of the respective K target signals, and to the reference input signal or to a corresponding one of the K individual reference input signals, each configured to provide a corresponding one of K noise reference signals by subtracting each of the K target signals from the reference input signal or from a corresponding one of said K individual reference input signals;

K adaptive interference cancellers, each responsive to the corresponding one of the respective K target signals, to the corresponding one of the K noise reference signals or a corresponding one of K equalized noise reference signals, respectively, each configured to provide a corresponding one of K output target signals;

a corresponding one of the K adaptive filters configured to generate one of K noise cancellation adaptive signals and provide each of said K noise cancellation adaptive signals to a corresponding one of the K complimentary adders; and the corresponding one of the K complimentary adders is configured to generate said each of the K output target signals by subtracting the corresponding one of the K noise cancellation adaptive signals from the corresponding one of the target signals, wherein said each of the output target signals is provided to the corresponding one of the K adaptive filters for continuing an adaptation process and for generating further values of the corresponding K output target signals.

31. The apparatus of claim 30, further comprising:

K equalization filter blocks, each responsive to the corresponding one of the K noise reference signals, each configured to provide the corresponding one of the K equalized noise reference signals.

32. The apparatus of claim 30, further comprising:

a post-processing block, responsive to the K output target signals, configured to provide P output system signals, wherein P is a finite integer of at least a value of one, wherein the post-processing block comprises at least one of a processing block and a control block, and further the post-processing block comprises at least one of a mixer and a conference/switch bridge.

33. The apparatus of claim 30, wherein said generalized sidelobe canceling system is implemented in a frequency domain, or in a time domain or in both the frequency and the time domain.

34. The apparatus of claim 30, further comprising:

a reference input generation filter, responsive to a preliminary reference input signal, configured to provide the reference input signal or the K individual reference input signals.

35. The apparatus of claim 30, further comprising a microphone array containing M microphones, responsive to an acoustic signal, configured to provide the M microphone signals.

36. A non-transitory computer-readable storage medium carrying computer-readable program instructions, the computer-readable program instructions comprising:

program instructions configured to receive an acoustic signal for generating M corresponding microphone signals, wherein M is a finite integer of at least a value of two;

program instructions configured to generate T+1 intermediate signals and a reference input signal in response to said M microphone signals or to M digital microphone signals by a beamformer and providing the T+1 intermediate signals to a target post-filter of the beamformer and the reference input signal to a complementary adder of a complementary noise separation filter, wherein T is a finite integer of at least a value of one program instructions configured to generate a target signal by the target post-filter and providing said target signal to the complementary adder and to an adder of an adaptive interference canceller;

program instructions configured to generate a noise reference signal by subtracting the target signal from the reference input signal using the complementary adder and provide said noise reference signal or an equalized noise reference signal to an adaptive filter block of the adaptive interference canceller for providing an output target signal by performing adaptive noise canceling in the target signal by the adaptive interference canceller to provide generalized sidelobe canceling;

program instructions configured to generate a noise cancellation adaptive signal by the adaptive filter block and provide said noise cancellation adaptive signal to the adder; and program instructions configured to generate said output target signal using the adder in the adaptive interference canceller by subtracting the noise cancellation adaptive signal from the target signal, wherein the output target signal is provided to the adaptive filter block for continuing an adaptation process and for generating a further value of the output target.

37. Apparatus comprising:

means for receiving an acoustic signal for generating M corresponding microphone signals, wherein M is a finite integer of at least a value of two;

means for generating T+1 intermediate signals and a reference input signal in response to said M microphone signals or to M digital microphone signals by a beamformer and providing the T+1 intermediate signals to a target post-filter of the beamformer and the reference input signal to a complementary adder of a complementary noise separation filter, wherein T is a finite integer of at least a value of one;

means for generating a target signal by the target post-filter and providing said target signal to the complementary adder and to an adder of an adaptive interference canceller;

means for generating a noise reference signal by subtracting the target signal from the reference input signal using the complementary adder and providing said noise reference signal or an equalized noise reference signal to an adaptive filter block of the adaptive interference canceller for providing an output target signal by performing adaptive noise canceling in the target signal by the adaptive interference canceller to provide generalized sidelobe canceling;

means for generating a noise cancellation adaptive signal by the adaptive filter block and providing said noise cancellation adaptive signal to the adder; and means for generating said output target signal using the adder in the adaptive interference canceller by subtracting the noise cancellation adaptive signal from the target signal, wherein the output target signal is provided to the adaptive filter block for continuing an adaptation process and for generating a further value of the output target signal.

38. The apparatus of claim 37, further comprising means for detecting acoustic signals, for providing the M microphone signals.

* * * * *

UNITED STATES PATENT AND TRADEMARK OFFICE

CERTIFICATE OF CORRECTION

PATENT NO. : 8,379,875 B2
APPLICATION NO. : 11/015755
DATED : February 19, 2013
INVENTOR(S) : Hämäläinen It is certified that error appears in the above-identified patent and that said Letters Patent is hereby corrected as shown below:

In the Specification

Column 1,
Lines 14 and 15, cancel "filed on even date herewith."

Signed and Sealed this
Twenty-seventh Day of August, 2013

Teresa Stanek Rea
*Acting Director of the United States Patent and Trademark Office*